US011713186B1

(12) United States Patent
Eisold

(10) Patent No.: US 11,713,186 B1
(45) Date of Patent: Aug. 1, 2023

(54) COIL TRANSPORTING INTERMODAL SHIPPING CONTAINER

(71) Applicant: Cakeboxx Technologies, LLC, McLean, VA (US)

(72) Inventor: Daine Edward Eisold, McLean, VA (US)

(73) Assignee: CAKEBOXX TECHNOLOGIES, LLC, McLean, VA (US)

( * ) Notice: Subject to any disclaimer, the term of this patent is extended or adjusted under 35 U.S.C. 154(b) by 413 days.

(21) Appl. No.: 16/817,829

(22) Filed: Mar. 13, 2020

Related U.S. Application Data

(60) Provisional application No. 62/817,738, filed on Mar. 13, 2019.

(51) Int. Cl.
*B65D 90/00* (2006.01)
*B65D 88/12* (2006.01)

(52) U.S. Cl.
CPC ..... *B65D 90/006* (2013.01); *B65D 88/121* (2013.01); *B65D 90/0026* (2013.01); *B65D 2590/0058* (2013.01)

(58) Field of Classification Search
CPC ..... B65D 25/00; B65D 25/10; B65D 25/103; B65D 25/102; B65D 85/00; B65D 85/02; B65D 85/04; B65D 88/121; B65D 88/12; B65D 90/004; B65D 90/006; B65D 2590/0058; B65D 2590/0041
USPC ..... 206/389, 408, 390, 391
See application file for complete search history.

(56) References Cited

U.S. PATENT DOCUMENTS 2,958,492 A * 11/1960 Maynard ..... B65D 85/66 211/44
3,392,682 A * 7/1968 Francis ..... B61D 45/003 105/422
6,543,368 B1 * 4/2003 Forbes ..... B61D 3/16 105/396
10,518,823 B1 * 12/2019 Childress ..... B62D 33/08

FOREIGN PATENT DOCUMENTS

WO WO-2008107626 A1 * 9/2008 ..... B65D 85/66

* cited by examiner

*Primary Examiner* — Javier A Pagan
(74) *Attorney, Agent, or Firm* — Cermak Nakajima & McGowan LLP; James Creighton Wray

(57) ABSTRACT

Steel coil carrying intermodal shipping containers have strong bases with I beams supporting decks and paired opposite coil supports. Each support has trusses, formed of inward supporting beams, outward sloping outer legs, links between them and short inner legs extending through the deck and anchored to longitudinal I beams. Three dimensional covers have corner posts, sides, ends, tops and open bottoms with edges that seal to edges of the deck. The covers lift from the bases for loading and unloading steel coils.

15 Claims, 7 Drawing Sheets

COIL TRANSPORTING INTERMODAL SHIPPING CONTAINER

This application claims the benefit of U.S. Provisional Application No. 62/817,738 filed Mar. 13, 2020, which is hereby incorporated by reference in its entirety as if fully set forth herein.

SUMMARY OF THE INVENTION

A new coil carrier intermodal shipping container has a maximum gross weight based with a strongly supported base and truss-shaped downward and inward sloping coil supports positioned on the base.

The new intermodal shipping container coil carrier for steel sheet rolls has a strong base of longitudinal I-beams, joined by cross beams, box beams along sides and ends and a strong steel deck. Spaced opposite downward and inward sloping supports are mounted on trusses extending upward from the steel deck. The trusses have strong bases extending along the deck, strong sloping legs joined at right angles and stronger vertical inner legs that extend through the steel deck and are joined to the major supporting beams in the base. Five or more similar trusses hold the inward sloping opposite supports. The sloping supports are formed as box beams with inner reinforcements and are held on inward and downward sloping legs.

The coil-carrying intermodal shipping container has upper and lower corner fittings connected at corners of the base. The lower corner fittings are corner castings configured for connection with twist locks to fixed corner castings of cargo carrying decks of trailers, railroad cars or ships. When unloaded the intermodal shipping containers or their bases may be stacked and secured in the stacks with twist locks.

The upper corner fittings on the container base are upper corner casings with permanently installed twist locks configured for connecting to lower corner fittings at corners of a three-dimensional lid. The permanently installed twist locks hold an open bottom of the lid tightly on a periphery of the container base, completing the intermodal shipping container.

The cover lid has at its four corners heavy duty vertical box beam corner posts with upper and lower corner castings attached to each post. Upper side and end beams connect the corner posts at their tops. Lower side and end beams connect the vertical corner posts near their lower ends. The lower corner castings of the lids are connected with the permanently installed twist locks in the base vertical corner casings.

A coil carrying intermodal shipping container has a strongly supported base with plural longitudinal steel I beams and plural transverse steel I beams connected to the longitudinal I beams. Corner connectors are connected at corners of the base to ends of outermost longitudinal I beams and to ends of outermost transverse I beams. The corner connectors have upper corner fittings and lower corner fittings. Twist locks are permanently monitored in the upper corner fittings. A deck is connected to the longitudinal I beams. Coil carriers are mounted on the deck and are connected to the longitudinal I beams. The coil carriers have pairs of inward and downward sloping coil supports on inward and downward sloping inner beams connected at tops to longer outer legs and at bottoms to shorter inner legs. The shorter inner legs are connected to the longitudinal I beams.

The coil carrying intermodal shipping container has a three dimensional lid with vertical corner posts. The corner posts have upper corner castings and lower corner castings connected to each of the corner posts. The lower corner castings on the corner posts are connectable to the upper fittings on the corner connectors on the base. The lid has vertical sides with vertical longitudinal ends connected to the corner posts. The lid has vertical ends with vertical lateral edges connected to the corner posts. The lid has a top roof connected along its edges and corners to tops of the vertical sides, tops of the vertical ends and to tops of the vertical corner posts. The lid has an open bottom with edges configured for sealing with edges of the base when the twist locks are engaged.

Coil carriers have spaced paired inward sloping support beams, outer legs sloping outward from their tops and horizontal links connecting them, forming trusses. Inner legs connected to the trusses extend through the deck and connect to the longitudinal I beams. There are at least six trusses in each pair of coil supports.

Three coil carriers are mounted on the deck. Fastening pins beneath the openings in the deck are connected to the longitudinal beams for securing straps around coils supported on the coil carriers.

These and further and other objects and features of the invention are apparent in the disclosure, which includes the above and ongoing written specification, with the claims and the drawings.

DETAILED DESCRIPTION

Figure 1:
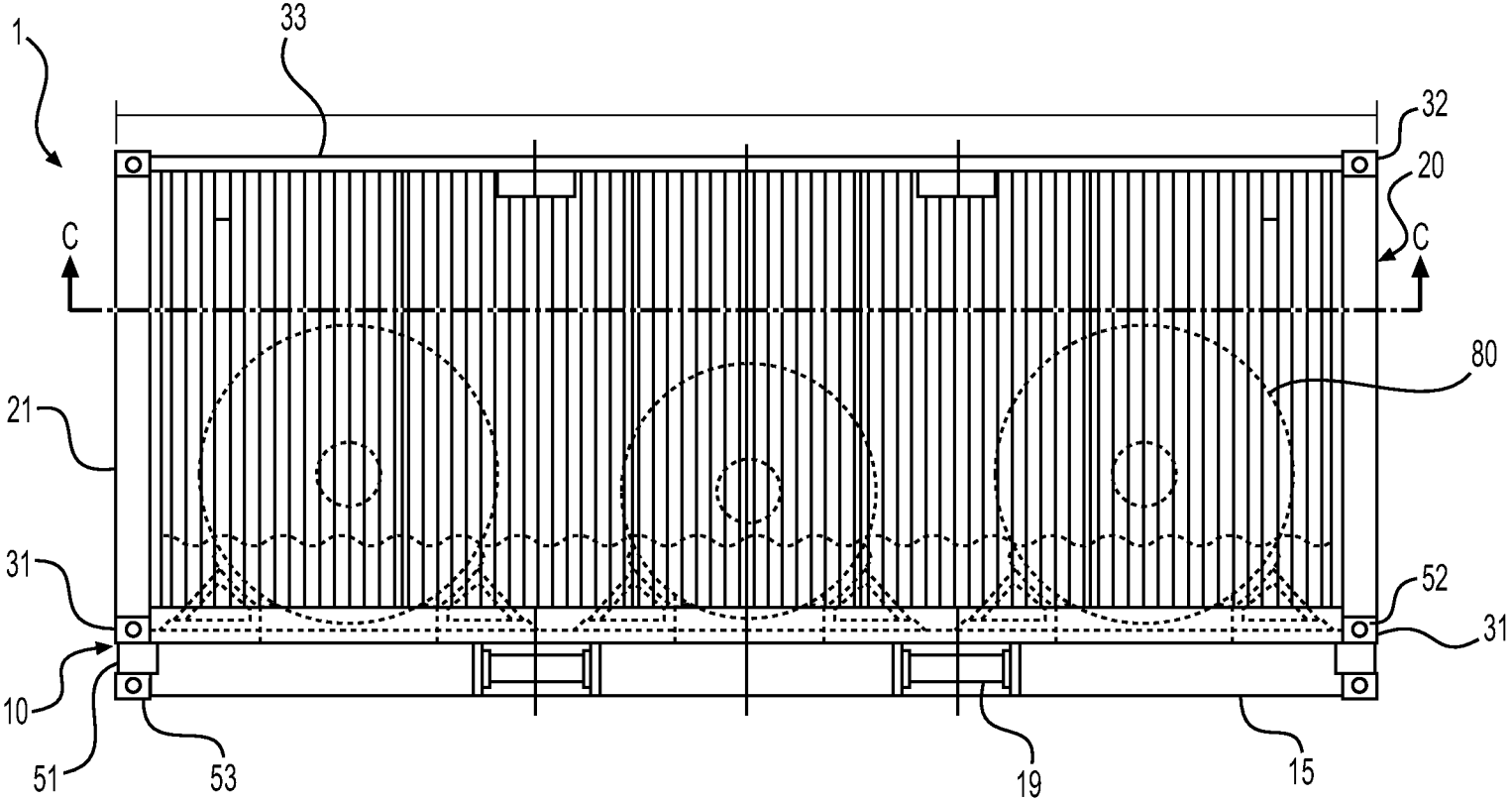
FIG. 1 is a side transparency view of the coil carrying intermodal shipping container showing coils positioned in the coil supports.
Figure 3:
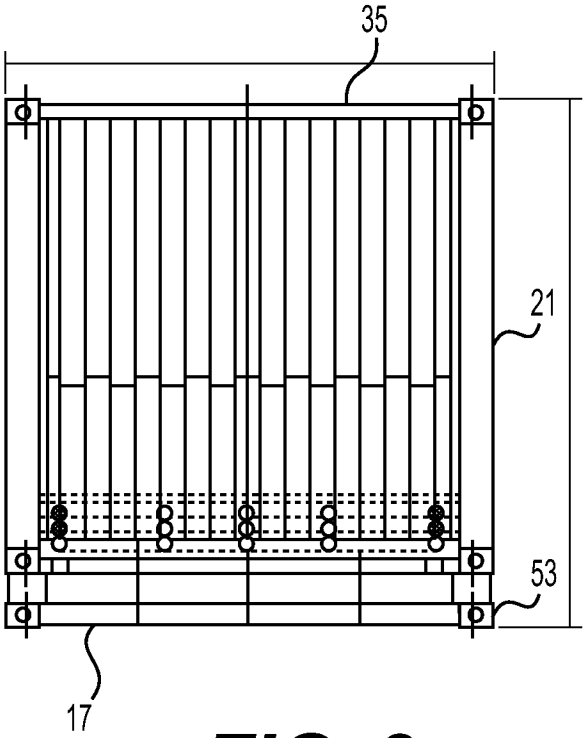
FIG. 3 is a rear view of the intermodal shipping container.
Figure 2:
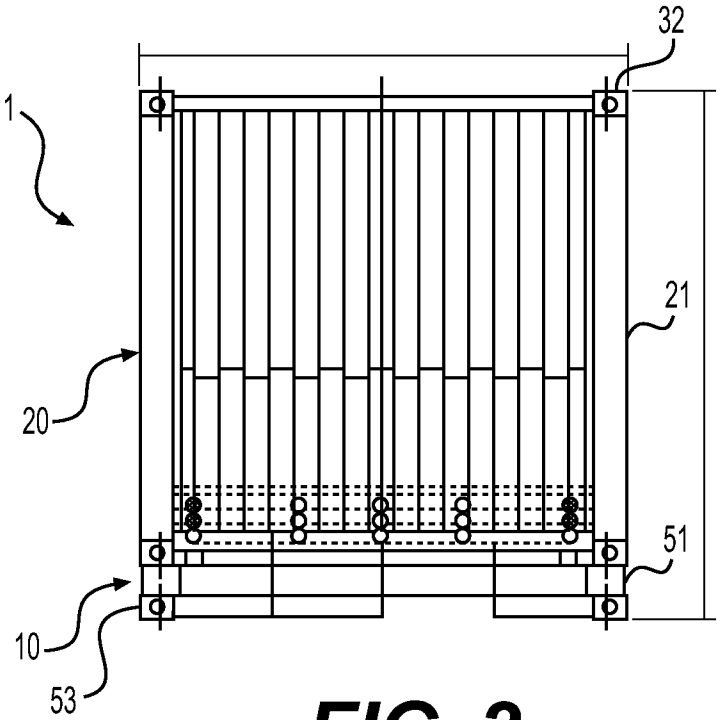
FIG. 2 is a front view of the intermodal shipping container.

FIG. 1 is a side view of the intermodal shipping container. The container 1 has a maximum strength base 10 formed of plural parallel I-beams 11 running in the longitudinal direction and plural cross beams 13 welded to the longitudinal I-beams. Side and end box beams 15 and 17 are welded at sides and ends of the support beams in the base 11. Fork lift tunnels 19 are provided through the lateral I-beams and side beams for lifting the container when empty.

In a covering lid 20, vertical corner post beams 21 are welded to the I-beams at lower corners 22 of the container lid 20. Lower corner fittings 31 are connected at intersections of lower side beams, lower end beams and lower ends of the vertical corner post beams 21. Upper corner fittings 32 are welded to tops of the corner beams 21. Ends of upper longitudinal beams 33 and upper end beams 35 are welded to the upper corner fittings 32. Corrugated sides, ends and a roof are connected and sealed to the beams to make the lid of the intermodal shipping container moisture tight.

A deck 40 is supported on the strong base 10. Deck 40 has a strong steel surface connected to the parallel I-beams and cross beams. Deck 40 has welded side and end box beams 15 and 17. Deck upper corner casings 51 are connected to upper corners of the side and end beams 15 and 17. The deck upper corner casings 51 are connectable to the lid 20 lower corner fittings 31 with twist locks 52 permanently installed in the corner casings 51. The lower corners of the deck have lower corner castings 53 that are connected to fixed corner castings on trailers, train cars and ships with twist locks for intermodal transportation.

The strong steel deck 40 has a surface supported by the beams of the base 10. Coils 80 of steel sheets are held in the container 1 on sloping supports 60. The sloping supports 60 are mounted on spaced-apart steel beam trusses 61. Trusses 61 have inner vertical legs 63 that extend downward through the deck 40. Lower ends 64 of the legs 63 are attached to and supported on the longitudinal and cross beams 11, 13 of the base 10. Outward and downward sloping outer legs 93 have upper ends 92 attached to the inward and downward sloping supports 60. Lower ends 94 of the outer legs are attached to links 95 that complete the trusses 61. Five or more trusses support each elongated box beam 65 with flat surfaces 67 and inner supports 69. Two oppositely inward sloping box beams 65 support one coil 80.

In openings of the deck the longitudinal base beams 11 hold depressed fastening pins 72. Straps are placed around the coils 80 and fastened to the pins 72 before closing the lid on the container.

Figure 4:
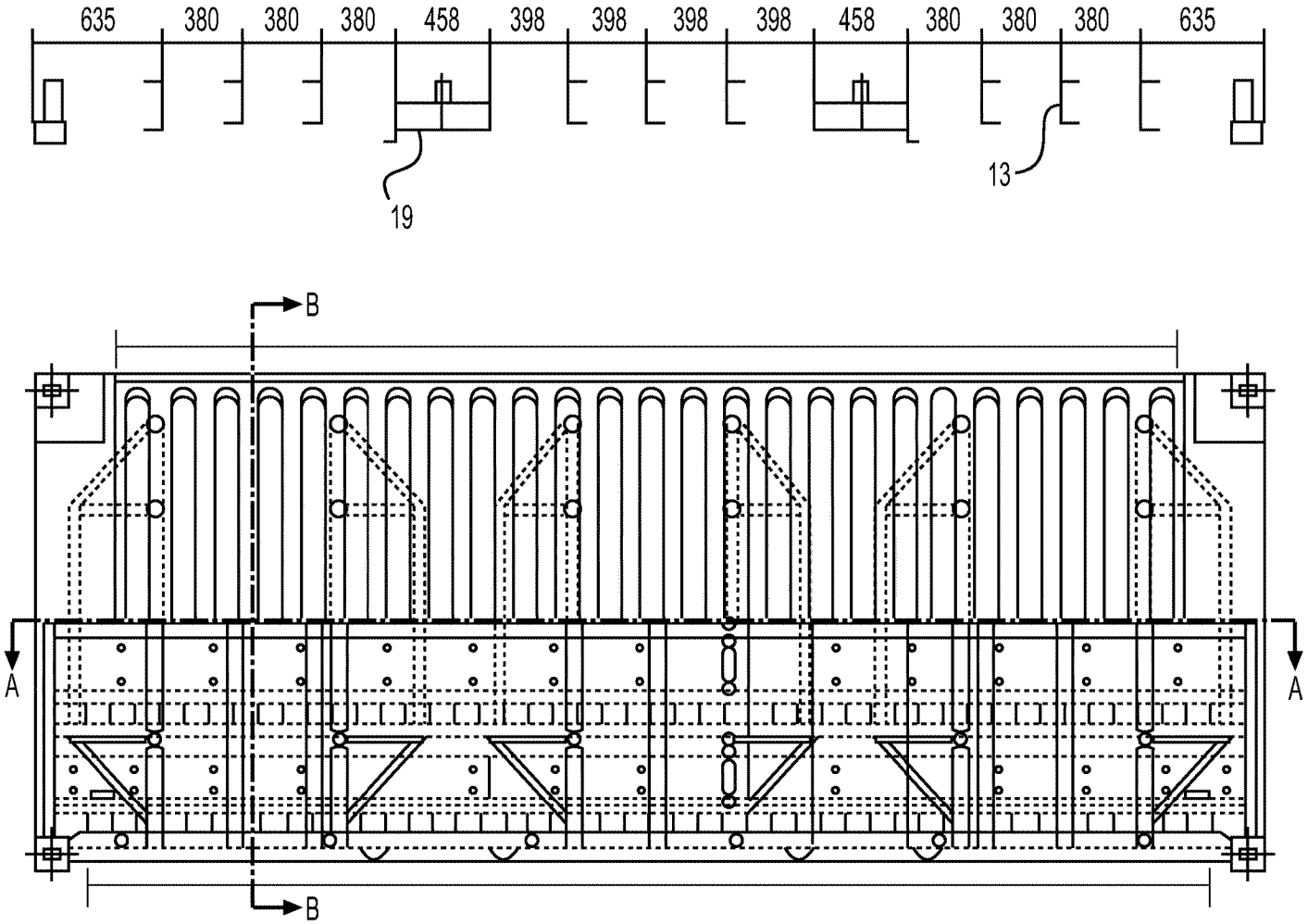
FIG. 4 is a top transparency view of the intermodal shipping container showing the coil supports.
Figure 5:
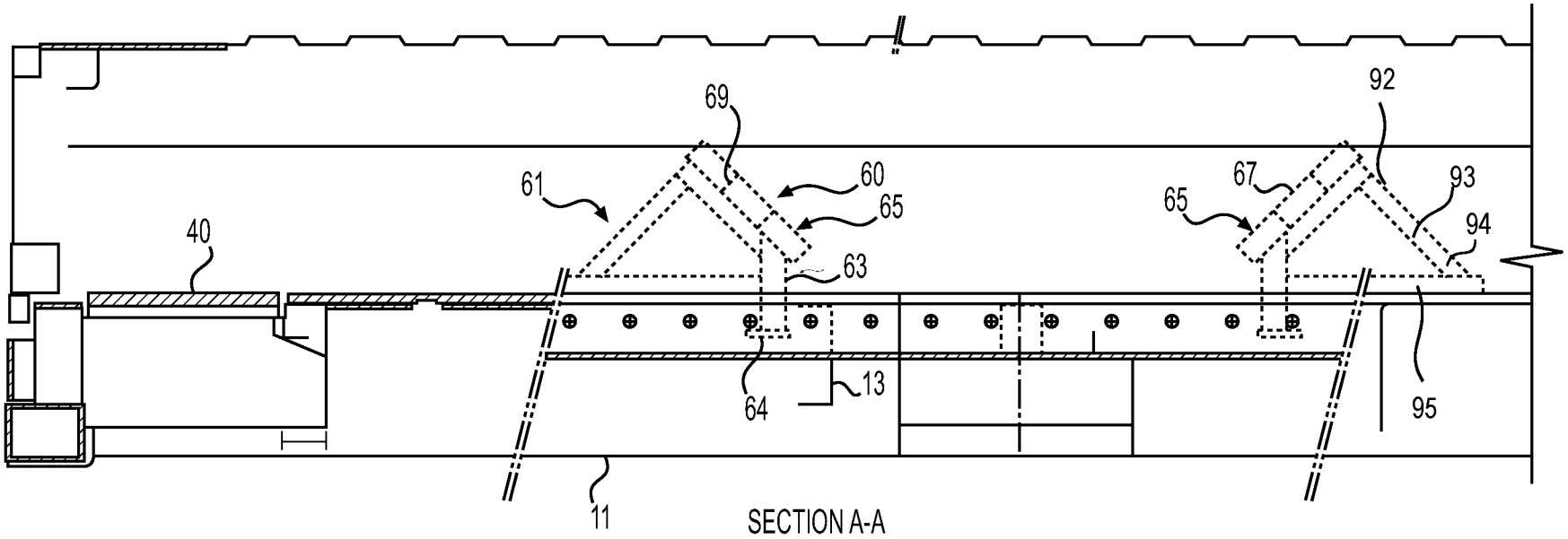
FIG. 5 is a detail showing an end view of one of the coil support pairs taken along line A-A of FIG. 4.
Figure 6:
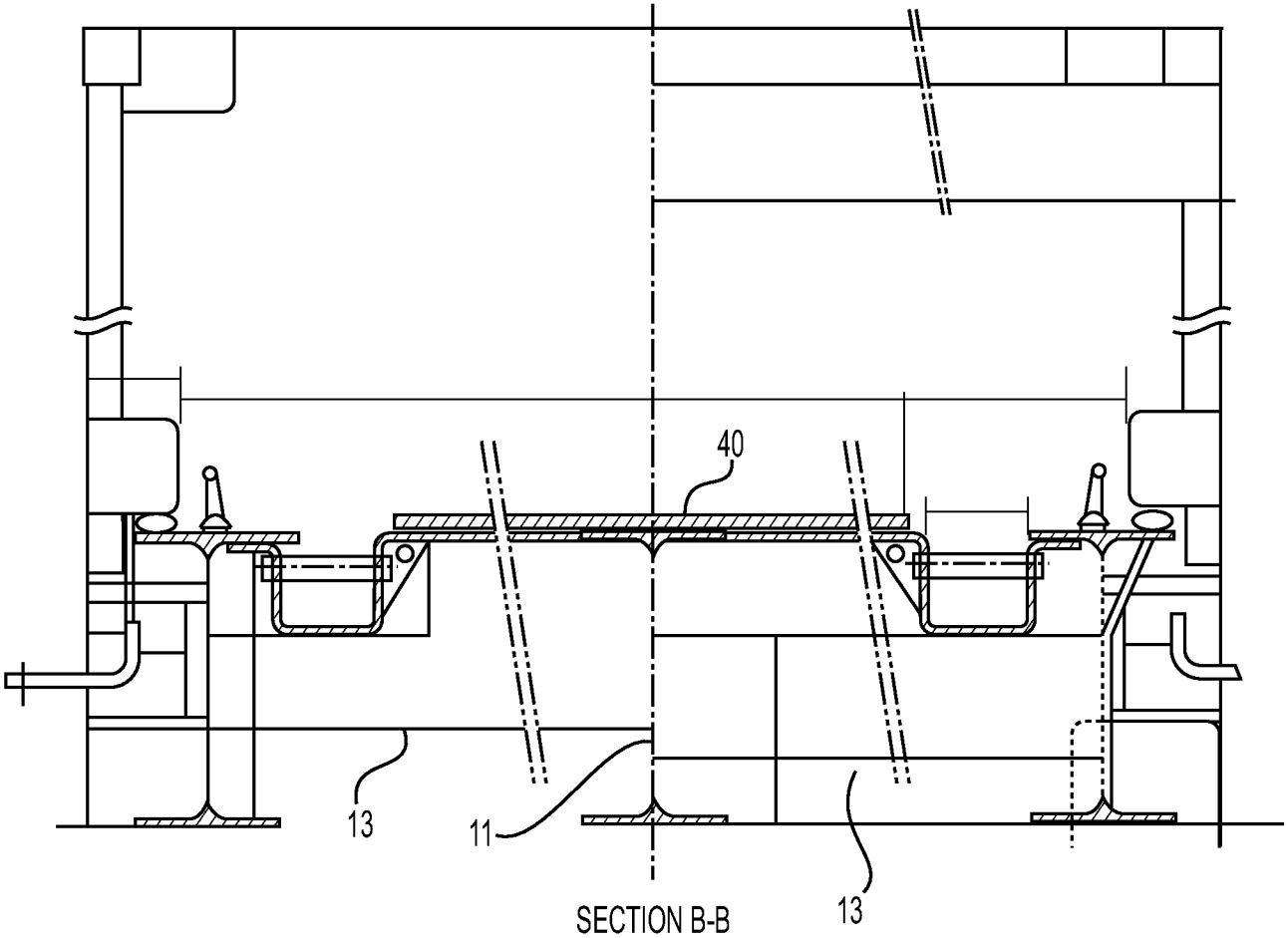
FIG. 6 is a cross-sectional detail taken along line B-B of FIG. 4.
Figure 7:
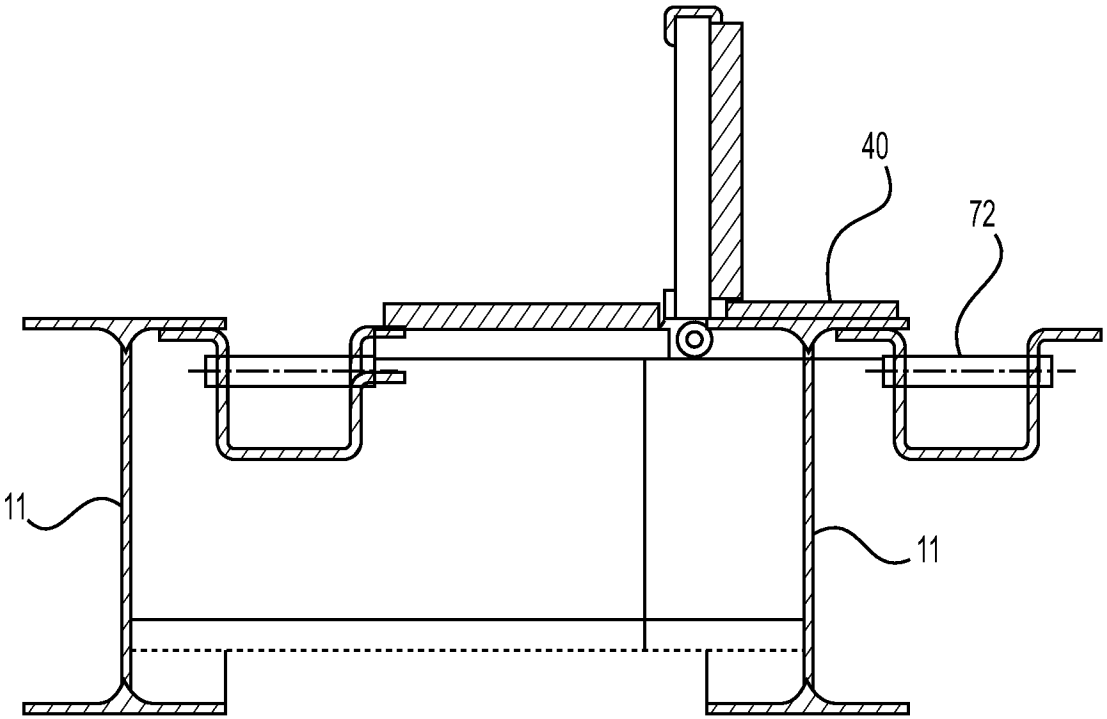
FIG. 7 is a detail of a tool box beneath the deck.
Figure 8:
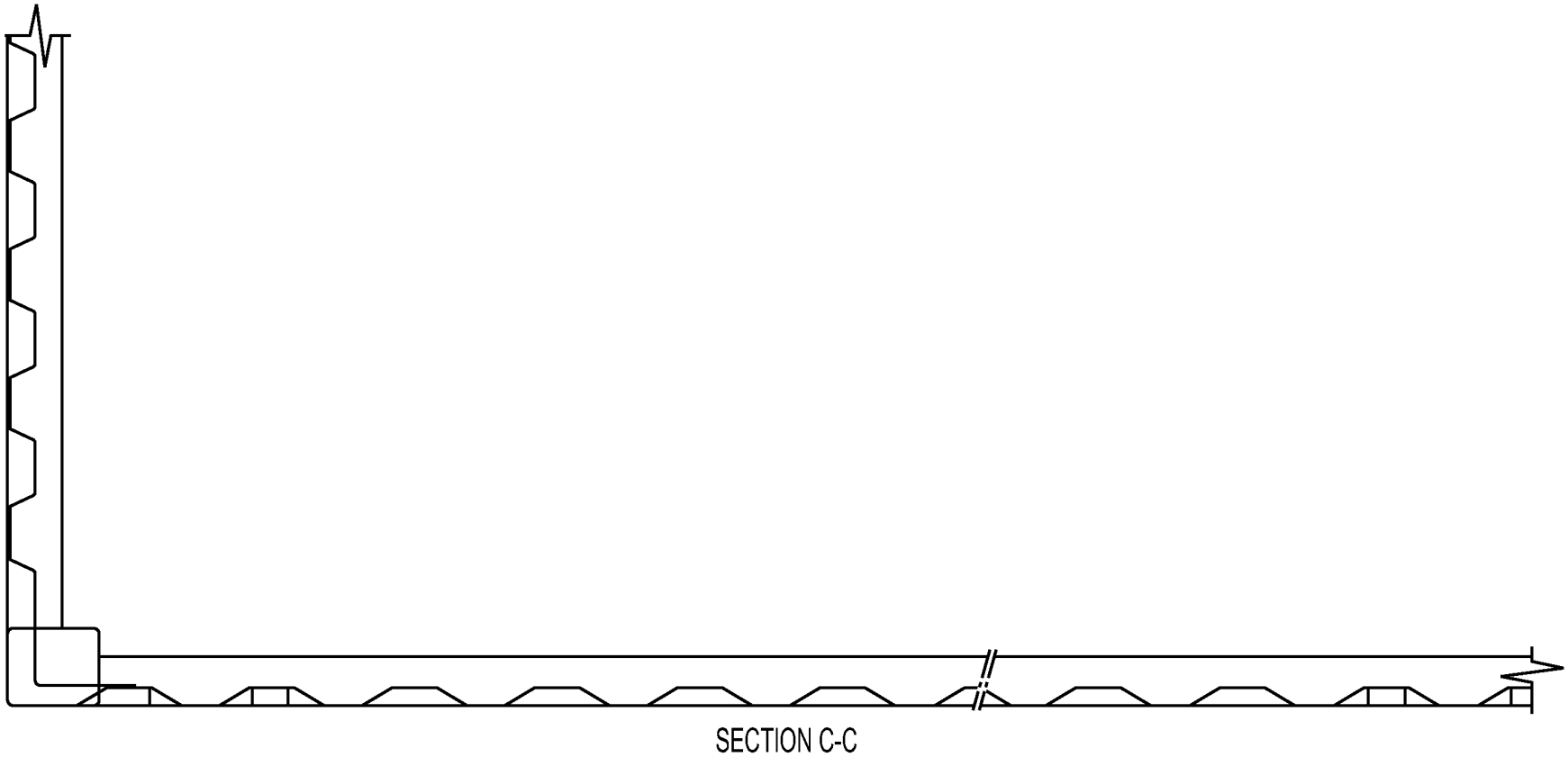
FIG. 8 is a detail of the lid structure taken along line C-C of FIG. 1.

The fork lift tunnels 19, as shown in FIGS. 1 and 4, are intended for use to move the heavyweight container 1 before coils 80 are loaded on the supports 60 and after the coils 80 are individually removed from the base 10 of container 1.

In operation the base 10 of an empty container is lifted on a trailer platform with a forklift and is connected with twist locks. The coils 80 are placed one by one with a forklift having a coil lifting attachment. The coils are strapped down. Then the lid 20 is lifted with a forklift and lowered onto the base. The lid and base are locked and sealed together with four corner twist locks permanently mounted within the vertical upper corner casings of the base.

When the container is secured on a ship, the sheet steel rolls 80 in an intermodal shipping container 1 are placed and locked on the ship's hold bottom or deck before additional lighter containers are supported atop the sheet steel rolls containers 1.

While the invention has been described with reference to specific embodiments, modifications and variations of the invention may be constructed without departing from the scope of the invention, which is defined in the following claims.

I claim:

1. Apparatus comprising a coil carrying intermodal shipping container having a strongly supported base with plural longitudinal steel I beams and plural transverse I beams connected to the longitudinal I beams, corner connectors connected at corner of the base to ends of outermost longitudinal beams and to ends of outermost transverse beams, the corner connectors having upper corner fittings and lower corner fittings, a deck connected to the longitudinal I beams, paired opposite coil carriers on the deck, the coil carriers connected to the longitudinal I beams, the paired coil carriers having inward and downward sloping coil supports connected near tops thereof to longer outer legs and connected near bottoms of the sloping coil supports to shorter inner legs connected to the longitudinal I beams; wherein horizontal links are connected between the outer legs and intermediate portions of the inner legs.

2. The apparatus of claim 1, further comprising a lid having vertical corner posts with upper corner castings and lower corner castings connected to each of the corner posts, the lower corner castings on the corner posts being connectable to the upper fittings on the corner connectors on the base, the lid having vertical sides with vertical longitudinal ends connected to the corner posts, the lid having vertical ends with vertical lateral edges connected to the corner posts, and the lid having a top roof connected along its edges and corners to tops of the vertical sides and of the vertical ends and tops of the vertical corner posts.

3. The apparatus of claim 2, wherein the lid has an open bottom with lower edges configured for sealing with edges of the deck.

4. The apparatus of claim 1, wherein the inner legs of the coil supports extend through the deck and lower portions of the inner legs are connected to the longitudinal I beams.

5. The apparatus of claim 4, further comprising openings in the deck and fastening pins beneath the openings in the deck connected to the longitudinal beams for securing straps around coils supported on the coil carriers.

6. The apparatus of claim 1, wherein the outer legs slope downward and outward from the inward and downward sloping coil supports.

7. The apparatus of claim 6, wherein the outer legs have lower ends that are connected to the links.

8. The apparatus of claim 1, wherein the coil supports, the inner legs, the outer legs and the links comprise trusses.

9. The apparatus of claim 8, wherein there are at least six trusses in each pair of coil supports.

10. The apparatus of claim 8, wherein corners of each truss are connected transversely across the deck.

11. The apparatus of claim 1, wherein three coil carriers are mounted on the deck.

12. A method comprising carrying steel coils in an intermodal shipping containers for shipment by trucks railroads and ships further comprising providing an intermodal shipping container having a strongly supported base, providing the base with plural parallel longitudinal steel I beams, providing plural transverse I beams, connecting the transverse I beams to the longitudinal I beams providing corner connectors on the base connecting the corner connectors to ends of outermost longitudinal beams and ends of outermost transverse beams providing the corner connectors with upper and lower corner fitting, providing a deck connected to the longitudinal I beams, providing paired coil carriers on the deck, each carrier having downward and inward sloping beams and supports and downward and outward sloping outer legs and links connected to bottoms of the beams and outer legs and having coil supports connected as part of the downward inward sloping beams, wherein horizontal links are connected between the outer legs and intermediate portions of the inner legs.

13. The method of claim 12, wherein the inner legs are connected to the links and to the downward and inward sloping beams, the inner legs extending through the deck and being connected to the longitudinal beams.

14. The method of claim 13, further comprising providing at least six trusses in each pair of coil carrier.

15. The method of claim 12, further comprising providing trusses with the downward and inward sloping beams and supports, the outward sloping outer legs, the links and the inner legs.

* * * * *